US005174202A

United States Patent [19]

Schlichting

[11] Patent Number: 5,174,202

[45] Date of Patent: Dec. 29, 1992

[54] METHOD FOR HOLDING A TEXTILE ARTICLE FOR SILK SCREEN PRINTING

[76] Inventor: Mary J. Schlichting, 75 E. Mountain Rd., Neshanic Station, N.J. 08853

[21] Appl. No.: 742,913

[22] Filed: Aug. 9, 1991

[51] Int. Cl.[5] ..... B41J 15/00; B41J 13/08

[52] U.S. Cl. ..... 101/129; 101/126; 101/474; 101/407.1

[58] Field of Search ..... 101/126, 129, 474, 407.1; 206/447; 15/104 A

[56] References Cited

U.S. PATENT DOCUMENTS

| | | | |
|---|---|---|---|
| 2,030,135 | 2/1936 | Carpenter | 206/447 X |
| 2,528,602 | 11/1950 | Magit | 206/820 X |
| 2,724,847 | 11/1955 | Krasno | 206/447 X |
| 3,501,797 | 3/1970 | Nappi | 206/447 X |
| 4,107,811 | 8/1978 | Imsande | 15/104 A X |
| 4,713,274 | 12/1987 | Minor | 15/104 A X |
| 4,837,062 | 6/1989 | Dunshee | 206/484 X |
| 4,875,268 | 10/1989 | Szarka | 101/407.1 X |

FOREIGN PATENT DOCUMENTS

| | | | |
|---|---|---|---|
| 962811 | 2/1975 | Canada | 15/104 A |
| 7083 | 1/1984 | Japan | 101/407.1 |
| 64378 | 4/1984 | Japan | 101/474 |

*Primary Examiner*—Edgar S. Burr
*Assistant Examiner*—Eric P. Raciti
*Attorney, Agent, or Firm*—John G. Gilfillan, III; John D. Kaufmann

[57] ABSTRACT

A method of temporarily attaching items to be screen printed to a pallet. The invention includes providing a pallet pad of adjacently adhered sheets on a pallet. Each sheet of the pad has a non-transferable adhesive coating on a substantial portion of its upper surface. The upper coating on each sheet permits the superjacent sheet to be removed without adversely affecting the adhesion of the coating. The upper coat on each sheet, once exposed, is capable of removably retaining textile articles thereon. Providing a bottom most sheet of the pad has a non-transferable adhesive coating over a substantial portion of its lower surface as well, adhering this lower coating of the pad on to the pallet and removably mounting a textile article to the adhesive coating of the upper surface on a topmost sheet of the pallet pad.

8 Claims, 1 Drawing Sheet

METHOD FOR HOLDING A TEXTILE ARTICLE FOR SILK SCREEN PRINTING

The present invention relates to apparatus and a method for holding an item to be screen printed.

BACKGROUND

The screen printing of items, such as shirts and other articles of clothing, for resale and distribution is often accomplished with a merry-go-round type apparatus. This apparatus includes arms from which pallets or holders extend. The arms are mounted to a hub or other member which is manually or automatically rotatable to rotate the arms and their pallets. In this way, each pallet may be serially presented to one or more screen printing stations and to subsequent drying stations or stations where other treatment is effected.

The pallets of the foregoing screen-printing apparatus are usually rectangular or square in shape and have a flat, planar surface. An item to be screen printed is typically temporarily attached to the pallet until the screen printing process is completed.

In the past, temporary attachment of an article to the pallet was achieved by first coating the pallets with a layer of a layer of a soft or tacky wax to which items to be screen printed would adhere. However, once the wax loses its tackiness, usually due to its retaining ink and/or fibers from the articles, it must removed by cleaning the pallet and then applying a fresh coat of wax. Another technique for temporarily attaching items to the pallets was to spray an aerosol adhesive on the pallets. Again, once the adhesive loses its tackiness due to ink and fiber residues, it must be removed. Removal usually involves the use of solvents on the pallets, which can adversely affect their surfaces.

An improvement in the above screen printing was a paper with a non-transferable adhesive on one side which is placed adhesive-side down on the pallets. The non-adhesive side is then sprayed with an aerosol-borne adhesive onto which, after curing, the item to be printed would be placed. This technique simplified cleaning the pallets, since one need only remove the paper.

Aerosol-borne adhesives used both in combination with paper and directly sprayed onto the pallets, once sprayed may travel beyond the pallet and adhere to some of the sensitive moving parts and mechanisms of the screen printing apparatus, thus causing possible damage and undue wear on the apparatus. Additionally, aerosol-borne adhesives contain fluorocarbons which have been found to cause considerable damage to the environment.

SUMMARY OF THE INVENTION

The present invention relates to apparatus and a method of temporarily attaching items to be screen printed to a pallet without any of the disadvantages of prior art techniques. The present invention avoids the use of fluorocarbon-containing aerosol-borne adhesives, as well as solvents, which damage the environment and which may cause harm to workers. Aerosol-borne adhesives, and solvents, may also cause wear and tear to the silk screen printing apparatus. The present invention will increase productivity and prove more economically efficient than the prior art apparatus and methods.

In one embodiment, the present invention is an apparatus for removably retaining textile articles to be screen printed. The apparatus includes an article holding pallet and a pad of adjacently adhered sheets on the pallet. Each sheet of the pad has a non-transferable adhesive coating on a substantial portion of its upper surface. The upper coating on each sheet permits the superjacent sheet to be removed without adverse effect on the adhesion of the coating. The upper coat on each sheet, once exposed, is capable of removably retaining textile articles thereon. The bottom-most sheet of the pad has a non-transferable adhesive coating over a substantial portion of its lower surface. This lower coating serves to adhere the pad to the pallet.

DETAILED DESCRIPTION

Figure 1:
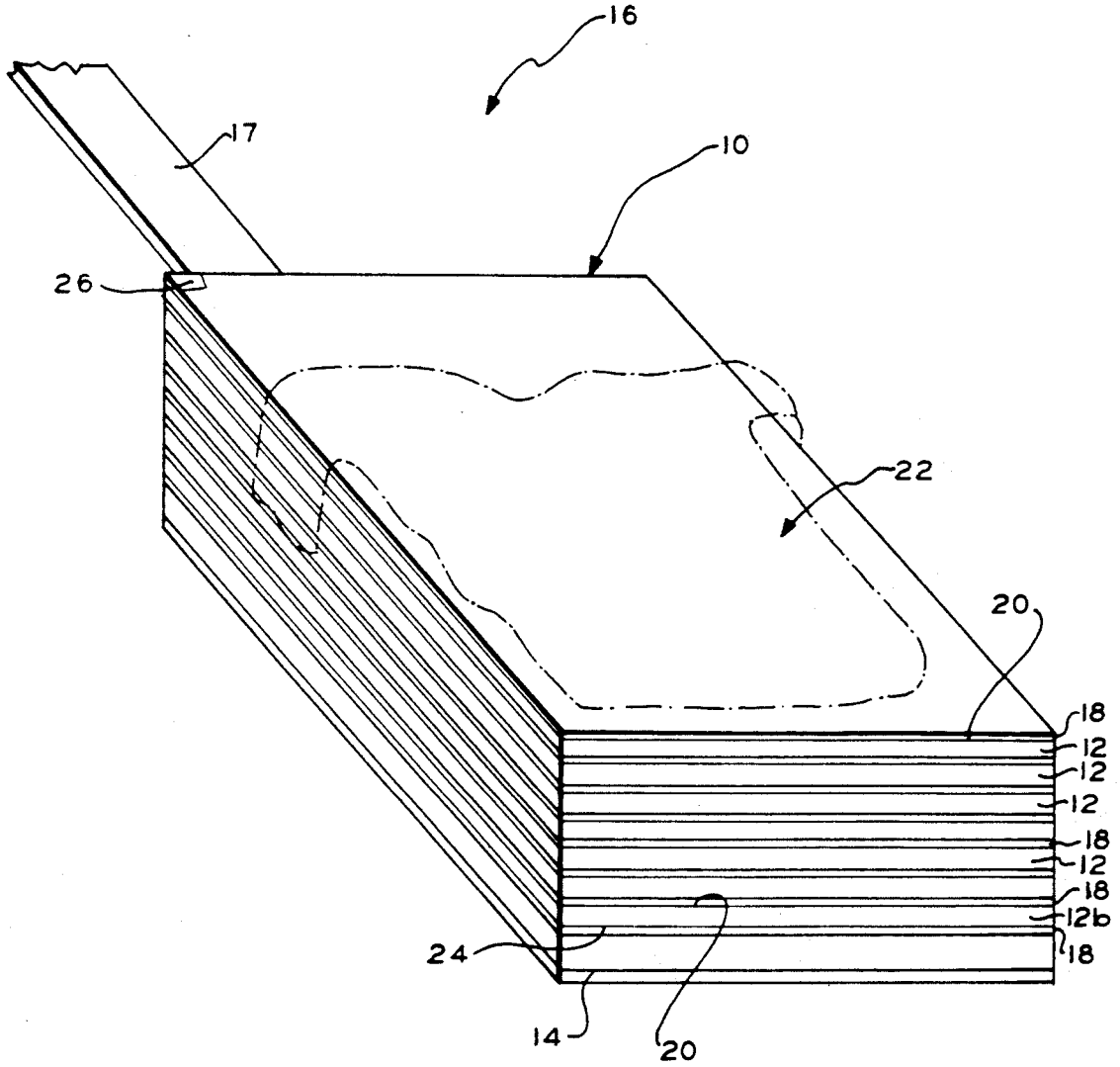
FIG. 1 is a highly exaggerated, not-to-scale view of a pad for a screen printing pallet according to the present invention.

The present invention comprises a pad 10 of sheets 12. The pad 10 is on a pallet 14 of a screen printing apparatus only generally indicated at 16. The pallet 14 is mounted to an arm 17 of the apparatus 16.

As shown in exaggerated fashion in the FIG., each sheet 12 has a non-transferable adhesive 18 on a substantial portion of its upper surface 20. The adhesive 18 adheres the sheets 12 together and, when exposed, is capable of removably retaining a textile article 22 thereon for screen printing. Removal of a superjacent sheet 12 or the article 22 does not adversely affect the adhesive 18, although residual ink or fibers may ultimately degrade the adhesive's retaining power. When this occurs, the top sheet 12 is removed to expose the adhesive 18 of the subjacent sheet 12.

The sheets 12 of the pad 10 of the present invention may be made of paper, polyethylene or other suitable material. Paper sheets can withstand the elevated temperatures incidental to flash heating of screen printed articles 22 which must be performed to facilitate the drying of certain colors before the next color can be applied. Therefore, paper sheets 12 must be capable of withstanding flash heating temperatures of from about 200° F. to about 800° F. for 2–3 seconds. An example of the type of paper sheet used is a latex or acrylic saturated paper sheet.

The thickness of paper sheets 12 should be from about 3.75 mil to about 5.0 mil, preferably 4.3 mil. The adhesive 18 applied to the paper sheets 12 is a non-transferable adhesive, preferably a water-based latex adhesive. The non-transferable adhesive 18 should have a sufficient tact value or adhesion pull so as to hold the textile article 22 to be silk screened without adversely affecting the textile article 22 being held. The strength of the non-transferable adhesive 18 may be varied depending upon the type of material used for the sheet 12 as well as upon the textile article 22 which is to be temporarily retained on the pallet 14. For example, the tack value or adhesive pull load may be from about 3 to about 6 ounces per lineal inch, preferably about 4.5 ounces per lineal inch.

Polyethylene sheets 12, of either a low or high density polyethylene are typically used for non-heat applications, although there may be polyethylene capable of withstanding exposure to high temperatures without melting or otherwise deteriorating. Polyethylene sheets 12 should have a thickness of from about 1.75 mils to about 3.0 mils, preferably about 2.0 mils.

The adhesive applied to the polyethylene sheets 12 is a non-transferable adhesive, preferably a water-based acrylic adhesive. The non-transferable adhesive 18 should have a sufficient tact value or adhesion pull so as to hold the textile article 22 to be silk screened without adversely affecting the textile article 22 being held. The strength of the non-transferable adhesive 18 may be varied depending upon the type of material used for the sheet 12 as well as upon the textile article 22 which is to be silk screened. For example, the tack value or adhesive pull load may be from about 2 ounces to about 4 ounces per lineal inch, preferably 3 ounces per lineal inch.

The bottom-most sheet 12*b* of the pad 10, whether the sheets 12 are paper, polyethylene or other materials, may be vinyl and coated on its upper surface 20 and its lower surface 24 with adhesive 18 for adhering the pad 10 to the pallet 14.

The pad 10 may also have a top sheet (not shown), which does not have an adhesive coated surface, for packaging and shipping purposes.

The side of the polyethylene sheets to which the nontransferable adhesive is applied may be corona treated prior to applying the adhesive, to facilitate the adhesion of the adhesive to the polyethylene surface.

Once the pad 10 is adhered to the pallet 14 and the top non-adhesive sheet (if present) is removed, the pad 10 is ready for use. The article 22 to be screen printed is placed on the pallet 14 and flattened out on the top-most sheet 12. The adhesive 18 holds the article 22 flat for screen printing. After screen printing and further treatment (e.g., drying or heating) the article 22 is removed from the sheet 12.

One sheet 12 of adhesive-coated paper or polyethylene as disclosed herein is capable of temporarily retaining approximately 50 textile articles 22 for screen printing before losing its tackiness, due to retention thereon of fiber and ink residues. The sheet 12 can then be easily pulled off the subjacent sheet 12 and discarded. To aid in separating the top sheet 12 from the rest of the pad 10, each sheet 12 may have tab 26 which does not contain any adhesive 18 and which does not adhere to the subjacent sheet 12.

While the present invention has been described in conjunction with specific embodiments thereof, it is evident that many alternatives, modifications and variations will be apparent to those skilled in the art in view of the foregoing description. Accordingly, the invention is intended to embrace all such alternatives, modifications and variations as falling within the broadest scope and spirit of the following claims.

Numerous modifications and variations of the present invention are possible in light of the above teachings, therefore, within the scope of the appended, the invention may be practiced otherwise than as particularly described.

What is claimed is:

1. A method for removably attaching a textile article to be silk screened to a silk screen printing pallet comprising the steps of:

a. providing a pallet pad of adjacently adhered sheets on the pallet, wherein each sheet has a non-transferable adhesive coating over a substantial portion of an upper surface thereof, the upper coating on a given sheet permitting the superjacent sheet to be removed without adversely affecting the adhesion of the upper coating on the given sheet, b. providing a bottom-most sheet on the pallet pad with non-transferable adhesive coating over a substantial portion of its lower surface, c. adhering the pallet pad to a pallet of a silk screen printing apparatus via the adhesive on the bottom-most sheet of the pallet pad, d. removably mounting a textile article to the adhesive coating of the upper surface on a top-most sheet of the pallet pad;

e. printing indicia on the textile article, f. removing the article, g. repeating steps d-f above with successive textile articles until the adhesive on the top most sheet no longer adequately adheres the textile article; and h. removing the top-most sheet of the pallet pad to expose a new sheet and a new layer of adhesive.

2. The method of claim 1, wherein the step of providing a pallet pad of adjacently adhered sheets includes providing sheets having a thickness of from about 3.75 to 5.0 mil.

3. The method of claim 2, wherein the step of providing a pallet pad of adjacently adhered sheets includes providing sheets having a thickness of about 4.30 mil.

4. The method of claim 2, wherein the step of providing a pallet pad of adjacently adhered sheets includes providing a non-transferable adhesive coating having an adhesion pull load of from about 3 to about 6 ounces per lineal inch.

5. The method of claim 4, wherein the step of providing a pallet pad of adjacently adhered sheets includes providing a non-transferable adhesive coating having an adhesion pull load of about 4 ounces per lineal inch.

6. The method of claim 1, wherein the step of providing a pallet pad of adjacently adhered sheets includes providing a non-transferable adhesive coating which is water-based.

7. The method of claim 1, wherein the step of providing a pallet pad of adjacently adhered sheets includes providing a tab forming a non-adhering portion of each sheet which does not adhere to an adjacent sheet.

8. The method of claim 1, wherein the step of providing a pallet pad of adjacently adhered sheets includes providing a bottom-most sheet made of vinyl.

* * * * *